US010070668B2

(12) United States Patent
Li et al.

(10) Patent No.: US 10,070,668 B2
(45) Date of Patent: Sep. 11, 2018

(54) REPLACEABLE ATOMIZING UNIT, ATOMIZER AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Shuyun Hu, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 195 days.

(21) Appl. No.: 14/980,865

(22) Filed: Dec. 28, 2015

(65) Prior Publication Data

US 2016/0192707 A1 Jul. 7, 2016

(30) Foreign Application Priority Data

Jan. 5, 2015 (CN) ..... 2015 2 0003150 U

(51) Int. Cl.
*A24F 47/00* (2006.01)
*H05B 3/00* (2006.01)

(52) U.S. Cl.
CPC ..... *A24F 47/008* (2013.01); *H05B 3/00* (2013.01)

(58) Field of Classification Search
CPC ..... A24F 47/008
See application file for complete search history.

(56) References Cited

U.S. PATENT DOCUMENTS

| | | | | |
|---|---|---|---|---|
| 9,737,093 | B2 * | 8/2017 | Hon | A24F 47/008 |
| 9,861,130 | B2 * | 1/2018 | Li | H05B 3/06 |
| 2013/0180533 | A1 * | 7/2013 | Kim | A24F 47/008 131/273 |
| 2014/0007891 | A1 * | 1/2014 | Liu | A24F 47/002 131/329 |

(Continued)

FOREIGN PATENT DOCUMENTS

| | | | | |
|---|---|---|---|---|
| EP | 2614732 | A1 * | 7/2013 | A24F 7/008 |
| EP | 3025598 | A1 * | 6/2016 | A24F 7/008 |
| WO | WO-2013149484 | A1 * | 10/2013 | A24F 7/008 |

OTHER PUBLICATIONS

"Ceramic Wick Tanks!!??" E-Cigarette Forum, Aug. 14, 2009, www.e-cigarette-forum.com/forum/threads/ceramic-wick-tanks.688130/.*

*Primary Examiner* — Jason L Lazorcik
*Assistant Examiner* — Taryn T Willett
(74) *Attorney, Agent, or Firm* — Cheng-Ju Chiang

(57) ABSTRACT

An exemplary replaceable atomizing unit includes a liquid conducting body, a heating element in contact with the liquid conducting body, a holder, and a press fit element. The holder is configured for supporting the liquid conducting body. The holder includes an open end. The press fit element is coupled with the open end. The press fit element and the holder cooperatively define an atomizing chamber. The heating element is received in the atomizing chamber. The open end defines a gap for accommodating the liquid conducting body. At least one part of the liquid conducting body extends along the gap outside of the atomizing chamber. The atomizing unit further includes a resilient component nesting the open end, and the resilient component is tightly pressed against the liquid conducting body by the press fit element.

14 Claims, 11 Drawing Sheets

(56) References Cited

U.S. PATENT DOCUMENTS

2014/0190477 A1* 7/2014 Qiu ..... A61M 11/042 128/202.21
2014/0290677 A1* 10/2014 Liu ..... A61M 15/06 131/329
2014/0299140 A1* 10/2014 Liu ..... A61M 15/06 131/329
2014/0338684 A1* 11/2014 Liu ..... A24F 47/008 131/329
2014/0376895 A1* 12/2014 Han ..... A24F 47/008 392/395
2015/0034105 A1* 2/2015 Liu ..... A24F 47/008 131/329
2015/0059787 A1* 3/2015 Qiu ..... H05B 3/14 131/329
2015/0164146 A1* 6/2015 Li ..... A24F 47/008 131/329
2015/0189919 A1* 7/2015 Liu ..... A24F 47/008 131/329
2015/0216236 A1* 8/2015 Bless ..... B23K 26/20 131/328
2015/0257446 A1* 9/2015 Chung ..... A24F 47/008 131/329
2015/0272217 A1* 10/2015 Chen ..... A24F 47/008 131/329
2016/0000145 A1* 1/2016 Liu ..... A61M 15/06 131/329
2016/0015081 A1* 1/2016 Liu ..... H05B 3/16 131/329
2016/0015082 A1* 1/2016 Liu ..... A24F 47/008 131/329
2016/0073693 A1* 3/2016 Reevell ..... H05B 1/0244 131/329
2016/0135502 A1* 5/2016 Wang ..... B01F 3/04085 131/329
2016/0157522 A1* 6/2016 Zhu ..... F01K 5/00 131/329
2016/0192710 A1* 7/2016 Liu ..... H05B 3/40 131/329
2016/0198768 A1* 7/2016 Liu ..... H05B 1/0244 392/404
2016/0219935 A1* 8/2016 Qiu ..... A24F 47/008
2016/0262452 A1* 9/2016 Zhu ..... F01K 5/00
2016/0295920 A1* 10/2016 Liu ..... H05B 3/0014
2016/0360790 A1* 12/2016 Calfee ..... A24F 47/008
2017/0006922 A1* 1/2017 Wang ..... H05B 3/04
2017/0143040 A1* 5/2017 Liu ..... A24F 47/008
2017/0196266 A1* 7/2017 Chen ..... A24F 47/008
2017/0354182 A1* 12/2017 Liu ..... A24F 47/008

* cited by examiner

REPLACEABLE ATOMIZING UNIT, ATOMIZER AND ELECTRONIC CIGARETTE HAVING SAME

TECHNICAL FIELD

The present invention relates to electronic cigarettes, and particularly to a replaceable atomizing unit, an atomizer and an electronic cigarette using same.

BACKGROUND ART

A typical electronic cigarette includes a housing, a liquid chamber defined in the housing, and a replaceable atomizing unit. The atomizing unit is configured (i.e., structured and arranged) for absorbing tobacco liquid from the liquid chamber, and generating aerosol. The replaceable atomizing unit includes a liquid conducting body for absorbing tobacco liquid, a heating element, a holder, and a press fit element. The press fit element is coupled with the holder to fix the liquid conducting body.

Generally, the liquid conducting body is a glass fiber core or a ceramic rod, and the holder and the press fit element are made of metal. However, when the liquid conducting body is a ceramic rod, the ceramic rod may be crushed during assembling process.

What is needed, therefore, is a replaceable atomizing unit, an atomizer and an electronic cigarette using same, which can overcome the above shortcomings.

SUMMARY

A replaceable atomizing unit includes a liquid conducting body, a heating element in contact with the liquid conducting body, a holder, and a press fit element. The holder is configured for supporting the liquid conducting body. The holder includes an open end. The press fit element is coupled with the open end. The press fit element and the holder cooperatively define an atomizing chamber. The heating element is received in the atomizing chamber. The open end defines a gap for accommodating the liquid conducting body. At least one part of the liquid conducting body extends along the gap outside of the atomizing chamber. The atomizing unit further includes a resilient component nesting the open end, and the resilient component is tightly pressed against the liquid conducting body by the press fit element.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
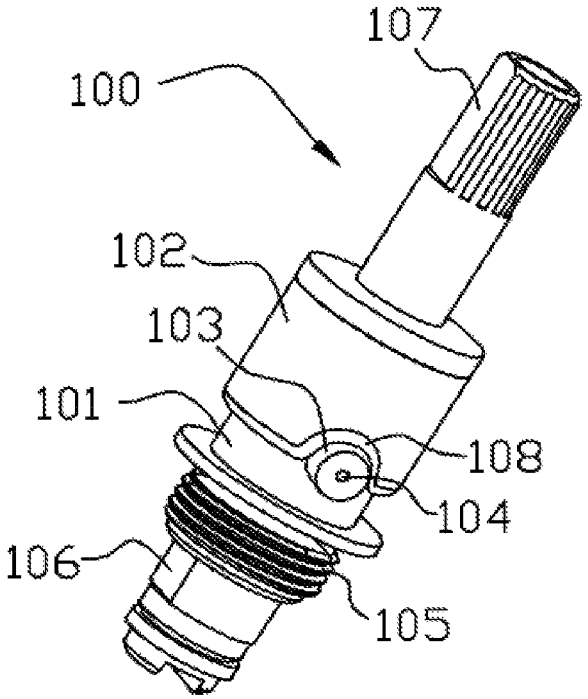
FIG. 1 is a perspective view of an atomizing unit according to a first embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

First Embodiment

Figure 2:
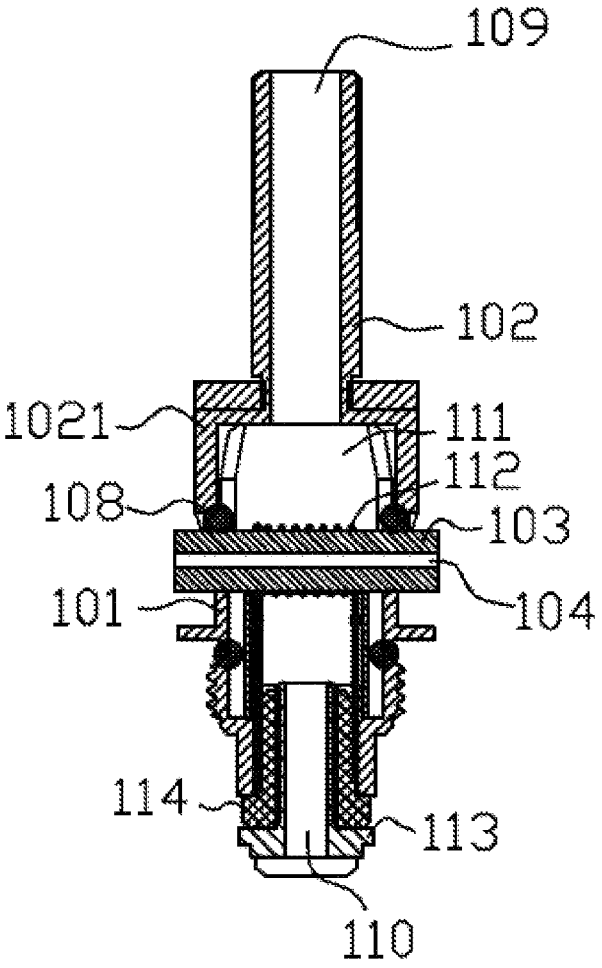
FIG. 2 is a cross-sectional view of the atomizing unit of FIG. 1.
Figure 3:
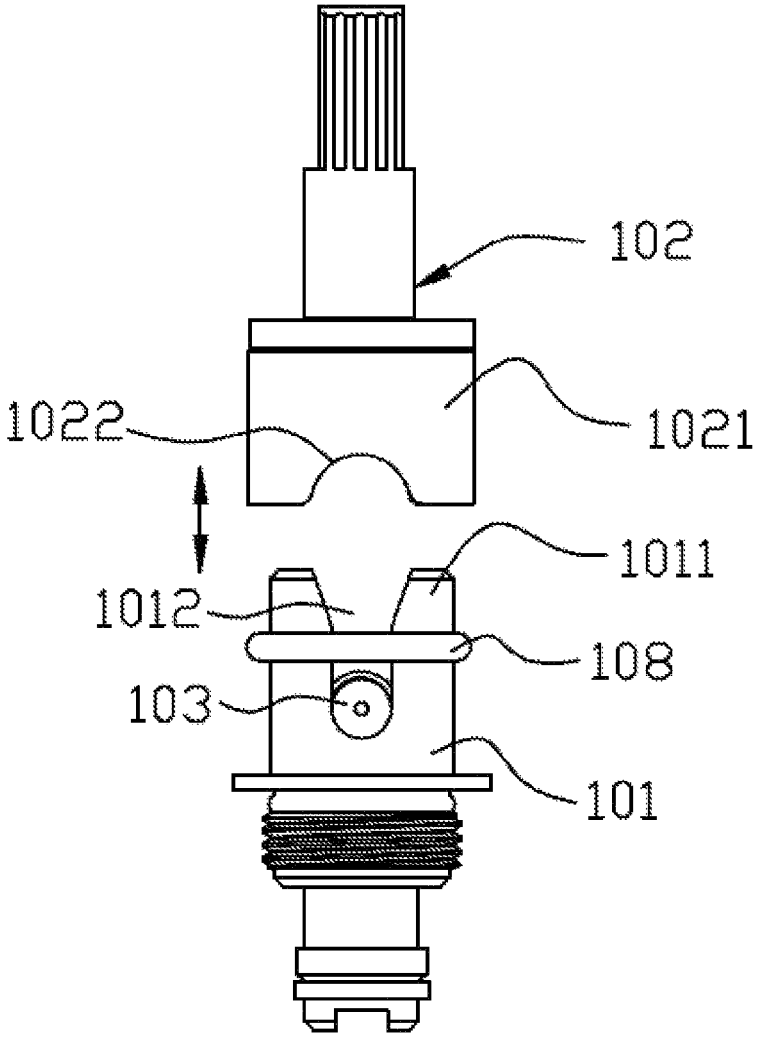
FIG. 3 is an exploded side view of the atomizing unit of FIG. 1.

Referring to FIGS. 1-3, a replaceable atomizing unit 100 includes a liquid conducting body 103, a heating element 112 and a holder 101. The liquid conducting body 103 is configured (i.e., structured and arranged) for absorbing tobacco liquid. The heating element 112 is in contact with the liquid conducting body 103, and configured for heating the tobacco liquid to form aerosol. The holder 101 is adapted for supporting the liquid conducting body 103. The holder 101 includes an open end 1011, and a press fit element 102 is coupled with the open end 1011. In the present embodiment, the holder 101 and the press fit element 102 are both substantially cylindrical, and cooperatively form an atomizing chamber 111 after engagement. The heating element 112 is arranged in the atomizing chamber 111. The liquid conducting body 103 is supported by the holder 101, and at least part of the liquid conducting body 103 extends outside of the atomizing chamber 111.

A resilient component nests the open end 1011, and a bottom end of the press fit element 102 sleeves the open end 1011. The bottom end of the press fit element 102 makes the resilient element abut against the liquid conducting body 103, so that the liquid conducting body 103 is hermetically arranged between the press fit element 102 and the holder 101. The holder 101 includes a plurality of screw threads 105. The atomizing unit 100 is engaged in an atomizer via the screw threads 105.

In the present embodiment, the liquid conducting body 103 is rod-shaped, and is made of glass fiber, etc. Quite usefully, the liquid conducting body 103 is made of porous ceramic rod, and two opposite ends of the liquid conducting body 103 extends outside of the atomizing chamber 111. The heating element 112 is positioned at a middle part of the liquid conducting body 103, and in contact with the liquid conducting body 103. Quite usefully, the heating element 112 is evenly wound around the liquid conducting body 103 in a spiral form.

To make tobacco liquid spread more evenly, the liquid conducting body 103 defines a through hole 104, and the tobacco liquid can flow into the through hole 104 and permeate to a side surface. The holder defines an air inlet 110 at an end away from the open end, and the press fit element 102 defines an air outlet 109. The air inlet 110 and the air outlet 109 are both in communication with the atomizing chamber 111.

The open end 1011 defines two gaps 1012 for receiving the liquid conducting body 103. The gaps 1012 are oriented along an axial direction of the holder 101. In the present embodiment, the open end 1011 defines two gaps 1012. The liquid conducting body 103 is oriented substantially perpendicular to the axial direction of the holder 101. In the present embodiment, the resilient component is a silicone ring 108. The silicone ring 108 nests the open end 1011. When the press fit element 102 is coupled with the holder 101, the silicone ring 108 is tightly pressed against the liquid conducting body 103 by the press fit element 102.

The press fit element 102 includes a sleeving part 1021 configured for coupling with the holder 101. The sleeving part 1021 is hollow, and nests the open end 1011 hermetically via the silicone ring 108. The sleeving part 1021 defines recesses 1022 matching with shape of the liquid conducting body 103. In the present embodiment, the liquid conducting body 103 is cylindrical, and thus, the recesses 1022 are arc-shaped. The sleeving part 1021 and the open end 1011 are engaged via interference fit. During assembly process, a recess 1022 is in alignment with a correspondent gap 1012. After the holder 101 is assembled with the sleeving part 1021 of the press fit element 102, the holder 101 and the press fit element 102 cooperatively define a hole for allowing the liquid conducting body 103 to pass through. A diameter of the hole matches with that of the liquid conducting body 103. The silicone ring 108 is pressed tightly by the sleeving part 1021 to prevent liquid leakage. The holder 101 and the press fit element 102 are both made of hard material, for example, metallic material. If the liquid conducting body 103 is a porous ceramic rod, the porous ceramic rod will not be damaged easily due to the silicone ring 108 during the assembly process of the holder 101 and the press fit element 102. An outer diameter of the silicone ring 108 is slightly larger than an inner diameter of a cavity of the sleeving part 1021, so that the silicone ring 108 seals a gap between the holder 101 and the press fit element 102.

Referring to FIG. 2 again, the holder 101 is made of metallic material, a metallic tube 113 is further arranged in the holder 101, and is insulated from the holder 101. The air inlet 110 is defined in the metallic tube 113. An insulated ring 114 is provided between the metallic tube 113 and the holder 101. The metallic tube 113 and the holder 101 are electrically connected to the heating element 112, respectively.

Figure 4:
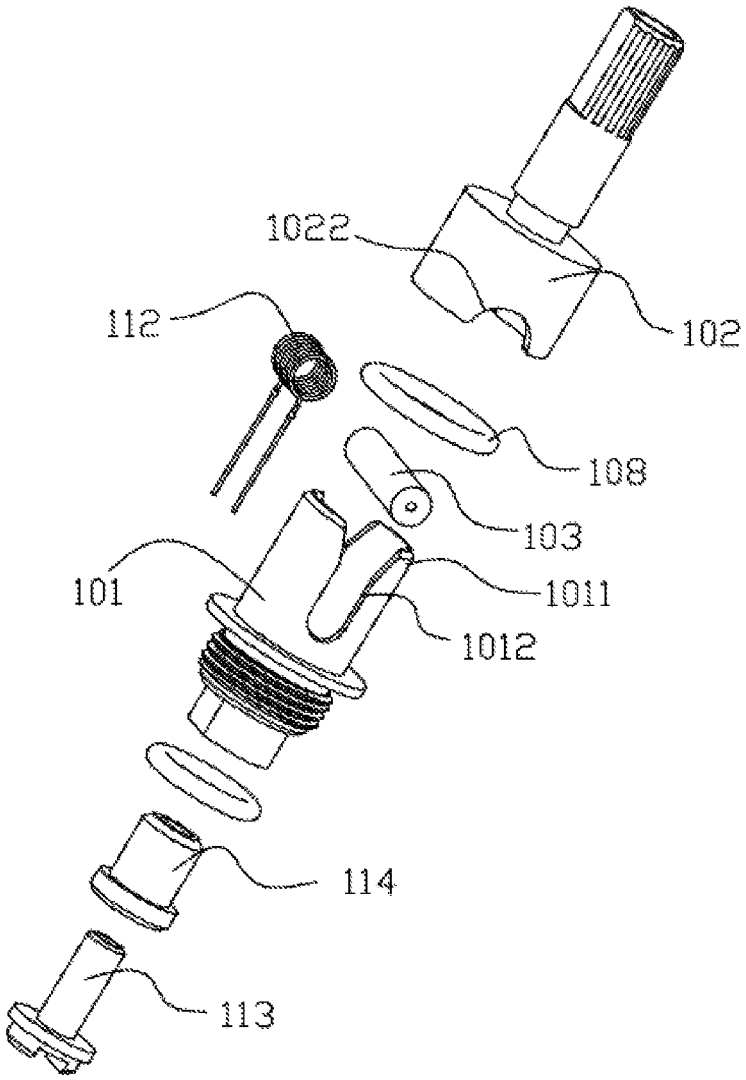
FIG. 4 is an exploded perspective view of the atomizing unit of FIG. 1.

Referring to FIG. 4, in assembly, the liquid conducting body 103 is placed into the gap 1012 in such a manner that two ends of the liquid conducting body 103 extends outside of the atomizing chamber 111. Then the open end 1011 is sleeved by the silicone ring 108, the press fit element 102 is pressed towards holder 101 in such a manner that a recess 1022 aligns with a corresponding gap 1012. Subsequently, the open end 1011 is nested by the sleeving part 1021, the silicone ring 108 is pressed tightly against the liquid conducting body 103, and the silicone ring 108 is deformed (as seen in FIG. 1). In addition, to make the recesses 1022 in accurate alignment with the gaps 1012, the holder 101 includes a positioning surface 106 and the press fit element 102 includes a positioning surface 107. The positioning surfaces 106, 107 are flat surfaces configured for being clamped by a tool.

Second Embodiment

Figure 5:
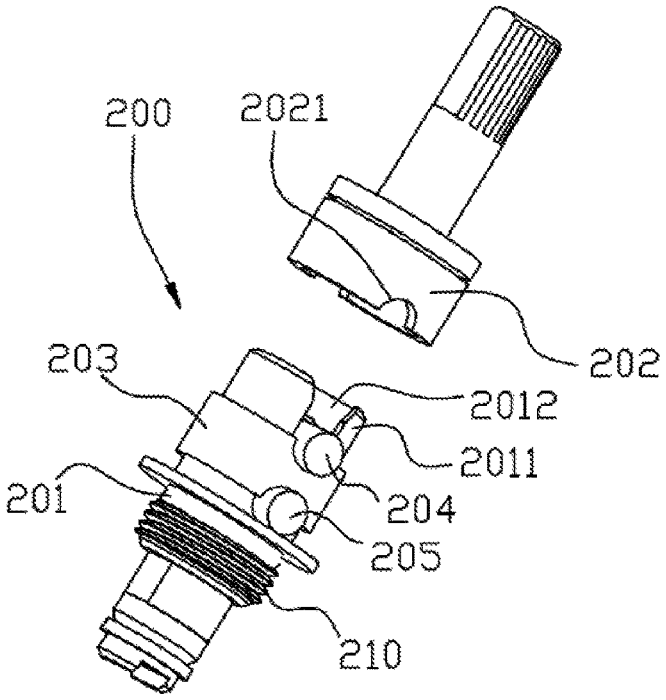
FIG. 5 is an exploded perspective view of an atomizing unit according to a second embodiment.
Figure 6:
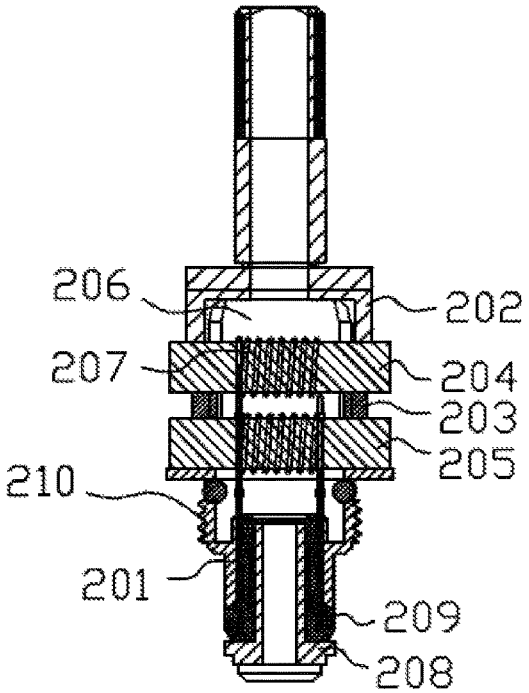
FIG. 6 is a cross-sectional view of the atomizing unit of FIG. 5.

Referring to FIGS. 5-6, another atomizing unit 200 is provided. The atomizing unit 200 is similar to the atomizing unit 100, except for a sum total of the liquid conducting bodies and a structure of the resilient component.

The atomizing unit 200 includes a holder 201, and a press fit element coupled to the holder 201. The holder 201 includes an open end 2011 at an end. The open end 2011 defines gaps 2012 for receiving liquid conducting bodies in a sidewall. A metallic tube 208 is provided at an opposite end of the holder 201. The metallic tube 208 serves as an electrode. An insulated ring 209 is arranged between the metallic tube 208 and the holder 201. The holder 201 further includes a plurality of external screws 210. Liquid conducting bodies 205, 204 are arranged in a parallel manner in the gaps 2012. The liquid conducting bodies 205, 204 are both porous ceramic rods. A heating element 207 is provided on the liquid conducting bodies 205, 204. A resilient component is sandwiched between the liquid conducting bodies 205, 204. In the present embodiment, the resilient component is a silicone sleeve 203. The silicone sleeve 203 nests the open end 2011, and two opposite ends of the silicone sleeve 203 are in contact with the liquid conducting bodies 205, 204, respectively. The press fit element 202 defines recesses 2021 matching with shapes of the liquid conducting body 204.

Figure 7:
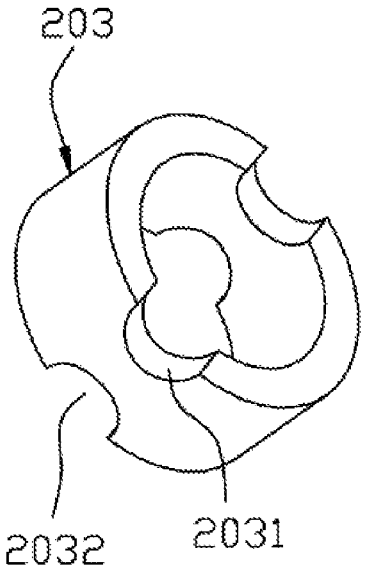
FIG. 7 is a perspective view of a resilient component in the atomizing unit of FIG. 5.

Referring to FIG. 7, the silicone sleeve 203 defines a pair of first recesses 2031, and a pair of second recesses 2032. A part of the liquid conducting body 204 is received in the first recesses 2031, and a part of the liquid conducting body 205 is received in the second recesses 2032.

It is to be understood that to increase an amount of aerosol, the atomizing unit 200 may include more than two liquid conducting bodies in other embodiments.

Third Embodiment

Figure 8:
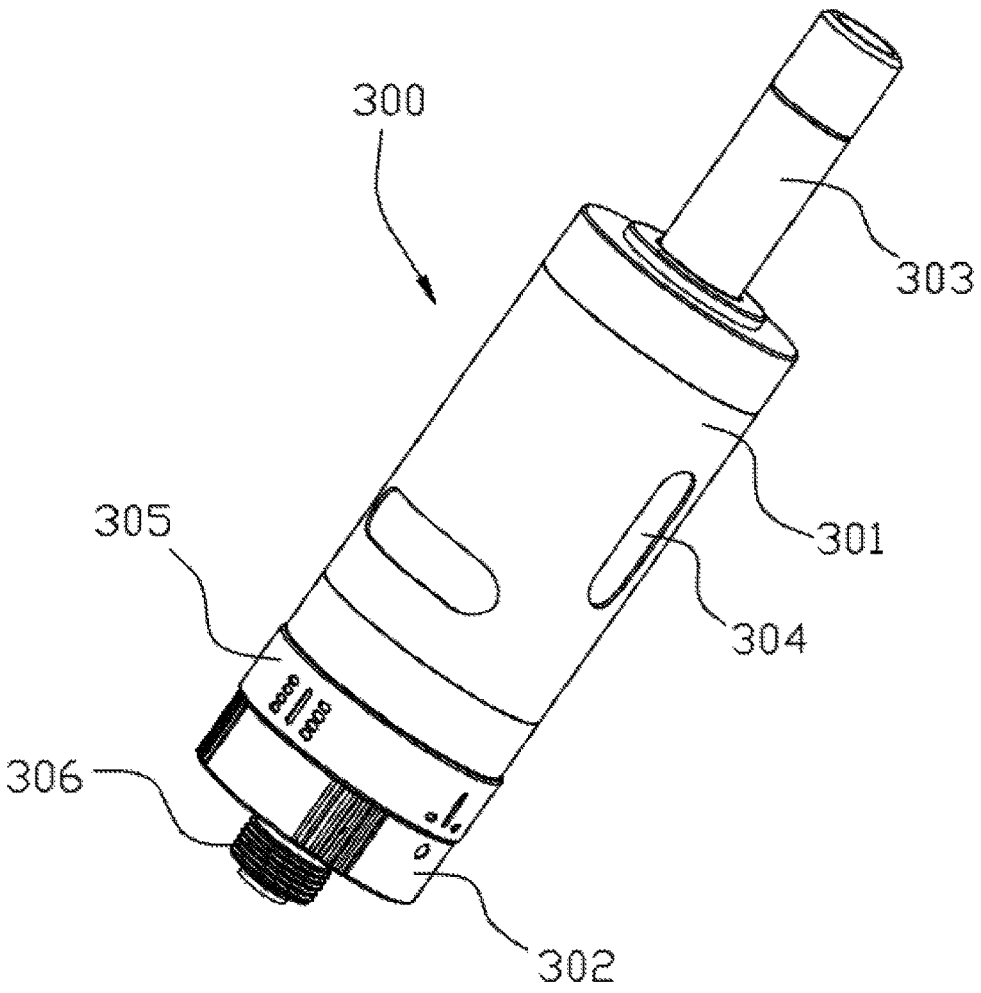
FIG. 8 is a perspective view of an atomizer according to a third embodiment.
Figure 9:
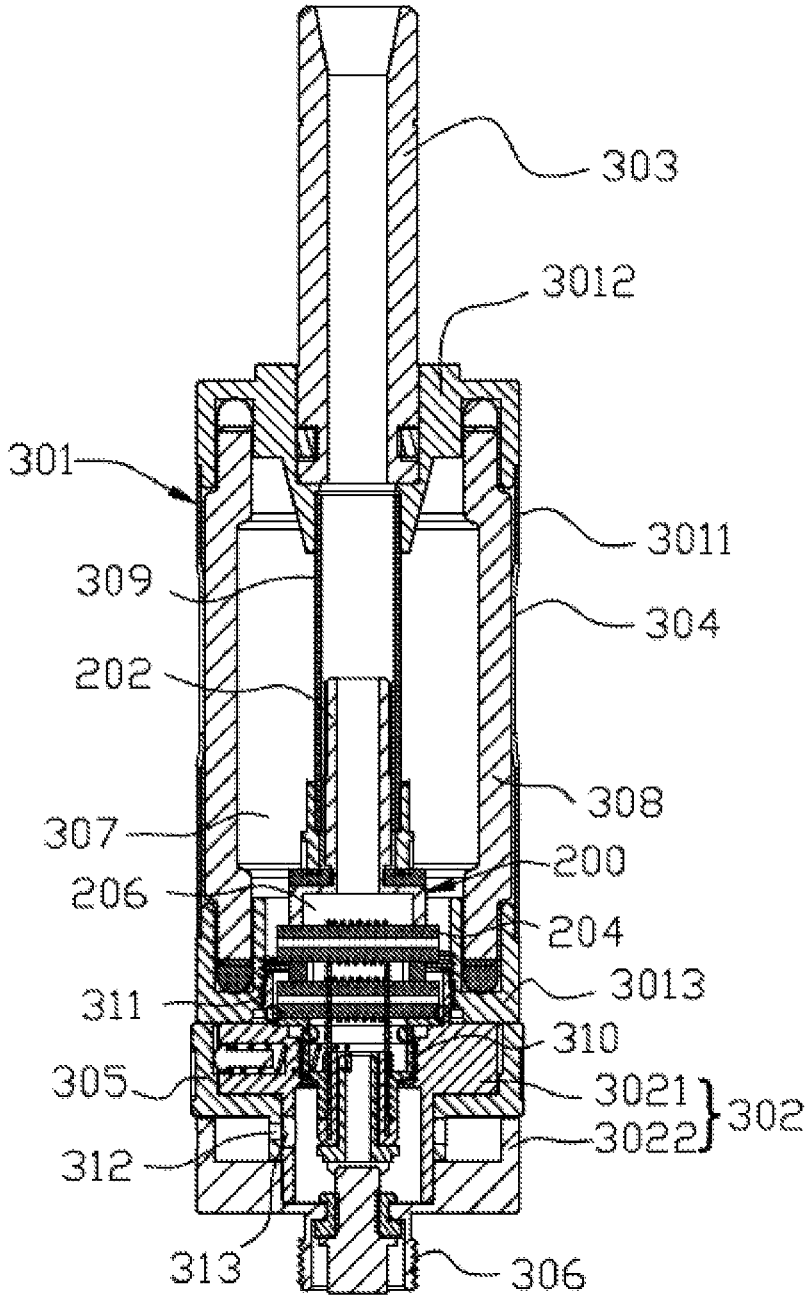
FIG. 9 is a cross-sectional view of the atomizer of FIG. 8.

Referring to FIGS. 8-9, an atomizer 300 includes a housing 301, an atomizing unit 200 received in the housing 301, and a liquid chamber 307 received in the housing 301. A mouthpiece 303 is arranged at an end of the housing 301, and the mouthpiece 303 communicates with the atomizing chamber 206 in the atomizing unit 200. An assembling holder 302 is provided at an opposite end of the housing 301. The atomizing unit 200 is detachably connected with the assembling holder 302. Two opposite ends of the liquid conducting bodies 204, 205 extend into the liquid chamber 307. The assembling holder 302 includes a plurality of screw threads 306 configured for connecting with a power supply at a bottom part.

Referring to FIG. 9, the housing 301 includes a sleeve tube 3011, a top cover 3012 and a bottom cover 3013 arranged at two opposite ends of the sleeve tube 3011. The housing 301 further includes a transparent tube 308 inside. The liquid chamber 307 is defined in the transparent tube 308. The housing 301 defines at least one window for observing tobacco liquid in the liquid chamber 307. An air pipe 309 is coaxially provided in the housing 301. An end of the air pipe 309 is connected with the mouthpiece 303, and an opposite end of the air pipe 309 is in communication with the atomizing chamber 206. The transparent tube 308 and the air pipe 309 cooperatively define an annular chamber, serving as the liquid chamber 307. Two opposite ends of the liquid chamber 307 is sealed by the top and the bottom covers 3012, 3013.

Figure 10:
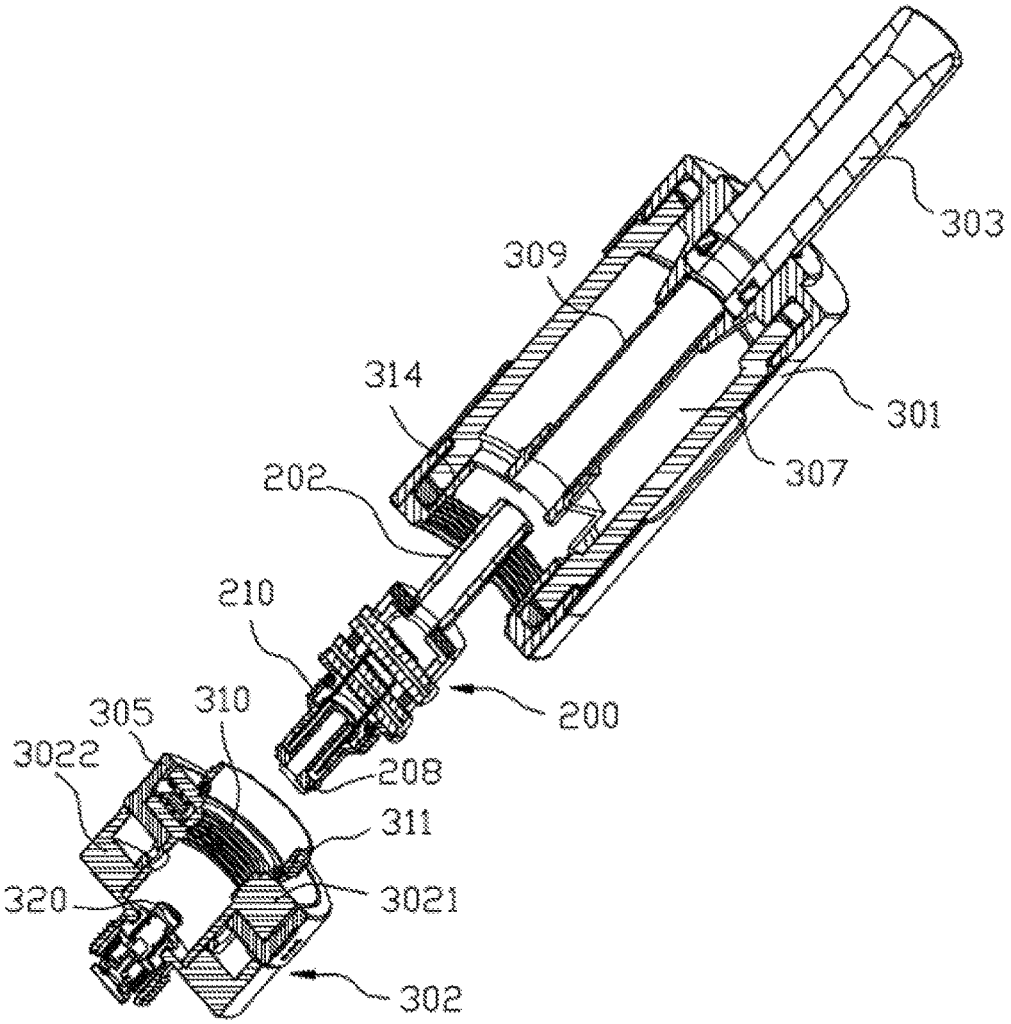
FIG. 10 is an exploded perspective view of an atomizer of FIG. 8.

The assembling holder 302 includes a plurality of internal screws 310 and a plurality of external screws 311. The assembling holder 302 is engaged with the housing 301 via the external screws 311 and internal screws 314 of the housing 301 (as seen FIG. 10). The assembling holder 302 is detachably engaged with the atomizing unit 200 via the internal screws 310. In detail, the assembling holder 302 includes a main body 3021 and an electrode sleeve 3022 fixedly connected with the main body 3021. The screw threads 306 are formed on the electrode sleeve 3022. An adjusting ring 305 is further provided in the assembling holder 302. The adjusting ring 305 is configured for adjusting air input. The adjusting ring 305 nests the main body 3021, and is positioned on the electrode sleeve 3022. Air goes into the atomizer 300 through a gap between an adjusting ring 305 and the electrode sleeve 3022. The air goes along a matching hole of the adjusting ring, and an air inlet hole 313 of the main body 3021, and then reaches the atomizing chamber 206. The structure of the adjusting ring 305 will be described in detail later.

In assembly, the atomizing unit 200 is first assembled into the assembling holder 302, the external screws 210 are coupled with inner screws of the assembling holder 302. The metallic tube 208 abuts against a contact electrode 320 of the assembling holder. Then, the atomizing unit 200 and the assembling holder 302 are together coupled to a bottom end of the housing 301.

Figure 11:
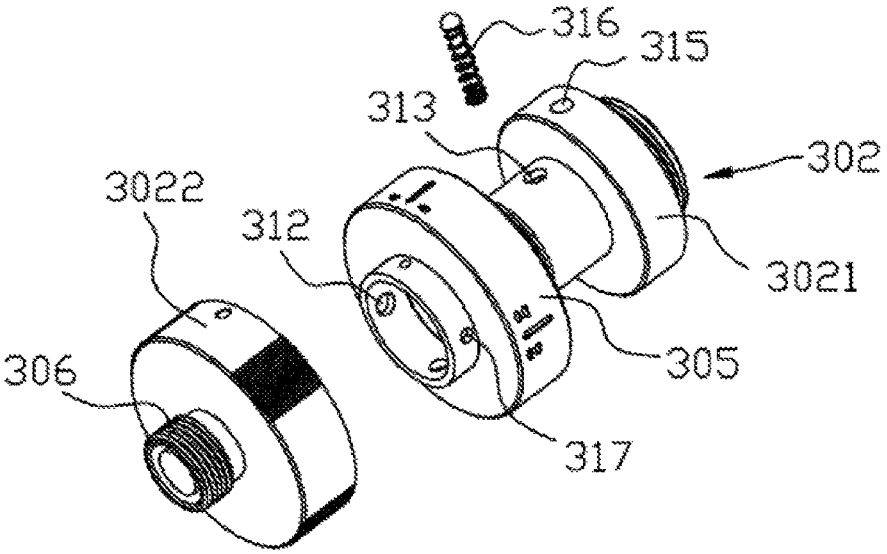
FIG. 11 is an exploded perspective view of an adjusting ring and an assembling holder according to a third embodiment.

Referring to FIG. 11, the main body 3021 of the assembling holder 302 defines an air inlet 313 in a sidewall. The adjusting ring 305 defines a plurality of matching holes, e.g., 312, 317 along a circumferential direction. A diameter of the matching hole 312 is larger than that of the matching hole 317. The adjusting ring 305 is rotatable relative to the main body 3021, so that the air inlet 313 is selectively in alignment with a respective matching hole. When the air inlet 313 aligns with a larger matching hole, an amount of the air input is more; when the air inlet 313 aligns with a smaller matching hole, an amount of the air input is less. The assembling holder 302 further includes an elastic pin 316, and the main body 3021 defines a receiving hole 315 for receiving the elastic pin 316. An end of the elastic pin 316 elastically abuts against an inner wall of the adjusting ring 305. The adjusting ring 305 defines a plurality of spaced recesses in the inner wall along a circumferential direction. When the air inlet 313 aligns with different matching holes, the elastic pin 316 is engaged in a respect recess.

Fourth Embodiment

Figure 12:
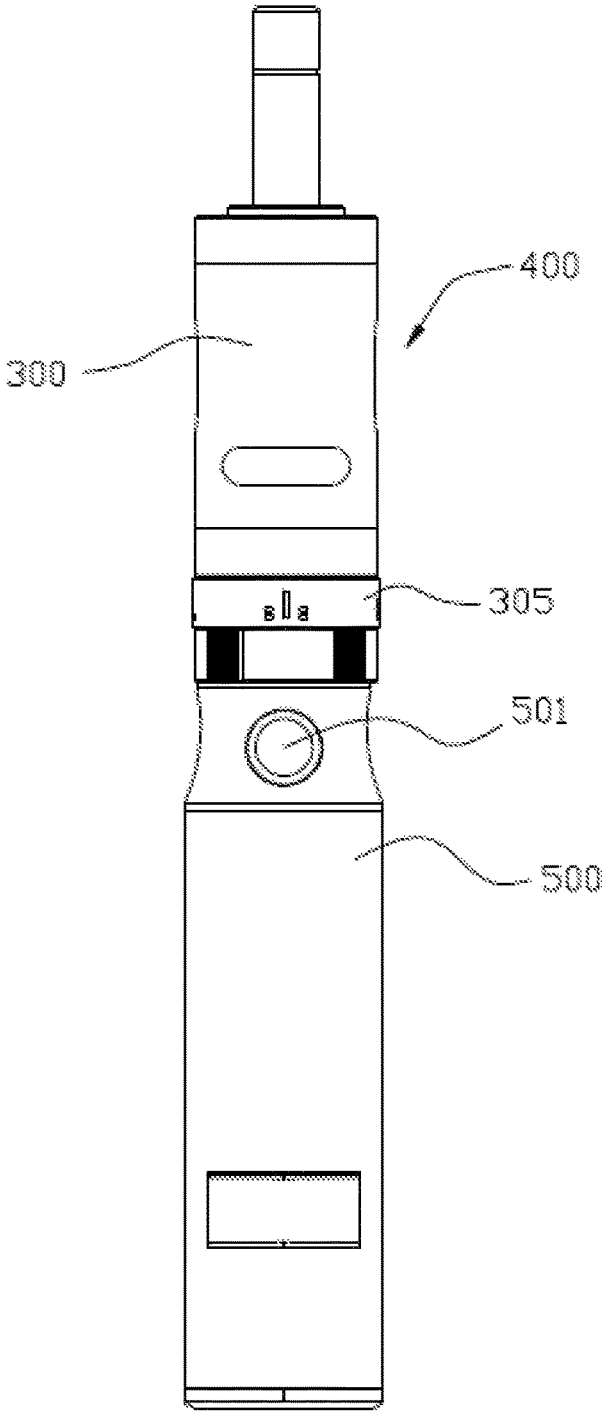
FIG. 12 is a side view of an electronic cigarette according to a fourth embodiment.

Referring to FIG. 12, an electronic cigarette 400 includes an atomizer 300 and a power supply 500 coupled with the atomizer 300. The atomizer 300 and the power supply 500 are detachably coupled. The power supply 500 is configured for supplying the heating element in the atomizer 300 power. The power supply 500 may include a rechargeable battery. The power supply 500 includes a switch 501 for activating the electronic cigarette 400.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. A replaceable atomizing unit, comprising:
- a first liquid conducting body;
- a heating element in contact with the first liquid conducting body;
- a holder configured for supporting the first liquid conducting body, the holder comprising an open end;
- a press fit element coupled with the open end, the press fit element and the holder cooperatively defining an atomizing chamber, the heating element being received in the atomizing chamber; and
- a resilient component disposed to surround outside the open end of the holder, and disposed next to the first liquid conducting body to be directly engaged with the first liquid conducting body;
- wherein the open end defines a gap for accommodating the first liquid conducting body, at least one part of the first liquid conducting body extends along the gap outside of the atomizing chamber, and the resilient component is deformed and tightly pressed against the first liquid conducting body by the press fit element when the press fit element is coupled with the open end.

2. The atomizing unit according to claim 1, wherein the first liquid conducting body comprises a porous ceramic rod, and two opposite ends of the ceramic rod extends along the gap outside of the atomizing chamber.

3. The atomizing unit according to claim 2, wherein the heating element is a heating wire wound around the ceramic rod.

4. The atomizing unit according to claim 2, wherein the ceramic rod defines a through hole.

5. The atomizing unit according to claim 1, wherein the holder defines an air inlet at one end away from the open end, the press fit element defines an air outlet, the air inlet and the air outlet both communicate with the atomizing chamber.

6. The atomizing unit according to claim 1, wherein the press fit element comprises a sleeving part, the sleeving part hermetically surrounds the open end, and the sleeving part defines a recess matching with a shape of the first liquid conducting body.

7. The atomizing unit according to claim 1, wherein the holder is substantially cylindrical, and the first liquid conducting body is substantially perpendicular to an axial direction of the holder.

8. The atomizing unit according to claim 1, wherein the resilient component is a silicone ring, an outer diameter of the silicone ring is larger than an inner diameter of the press fit element.

9. The atomizing unit according to claim 1, further comprising a second liquid conducting body, wherein the first and second liquid conducting bodies are oriented substantially parallel to each other, the resilient component is sandwiched between the first and second liquid conducting bodies, and the resilient component defines recesses matching with shapes of the first and second liquid conducting bodies, respectively.

10. The atomizing unit according to claim 1, wherein the holder is made of metallic material, the atomizing unit further comprises a metallic tube in the holder, the metallic tube is insulated from the holder, and the holder and the metallic tube are connected with two ends of the heating element.

11. The atomizing unit according to claim 1, wherein each of the holder and the press fit element comprises a positioning surface, and the positioning surface is a flat surface.

12. An atomizer for an electronic cigarette, comprising:

a housing;

an atomizing unit according to claim 1, the atomizing unit being arranged in the housing;

a liquid chamber configured for storing tobacco liquid;

a mouthpiece arranged at one end of the housing; and an assembling holder arranged at an opposite end of the housing;

wherein the atomizing unit is detachably engaged with the assembling holder, and the liquid conducting body extends outside of the atomizing chamber into the liquid chamber.

13. The atomizer according to claim 12, further comprising an adjusting ring arranged on the assembling holder, wherein the assembling holder defines an air inlet, the adjusting ring defines a plurality of first and second matching holes along a circumferential direction, a diameter of each of the plurality of first matching holes is different from a diameter of each of the plurality of second matching holes, the adjusting ring is rotatable relative to the assembling holder, so that the air inlet is selectively in alignment with an exclusive one of the plurality of first holes and the plurality of second holes, thus adjusting air input.

14. An electronic cigarette, comprising:

an atomizer according to claim 12; and a power supply connected with the atomizer, the power supply being configured for supplying the atomizer power.

* * * * *